US006844709B2

(12) United States Patent
Chuang et al.

(10) Patent No.: US 6,844,709 B2
(45) Date of Patent: Jan. 18, 2005

(54) PROGRAMMABLE VOLTAGE SUPERVISORY CIRCUIT AND METHOD WITH MINIMUM PROGRAMMING PINS AND LOW QUIESCENT CURRENT

(75) Inventors: Chao-Hsuan Chuang, Hsinchu (TW); Jing-Meng Liu, Hsinchu (TW); Cheng-Hsuan Fan, Hsinchu (TW); Kent Hwang, Taoyuan (TW)

(73) Assignee: Richtek Technology, Corp., Hsinchu (TW)

( * ) Notice: Subject to any disclaimer, the term of this patent is extended or adjusted under 35 U.S.C. 154(b) by 0 days.

(21) Appl. No.: 10/283,062

(22) Filed: Oct. 30, 2002

(65) Prior Publication Data

US 2004/0085053 A1 May 6, 2004

(51) Int. Cl.[7] ..... G05F 1/40; G05F 1/618
(52) U.S. Cl. ..... 323/284; 323/282; 330/282
(58) Field of Search ..... 330/282, 284; 323/282, 284

(56) References Cited

U.S. PATENT DOCUMENTS 6,009,022 A * 12/1999 Lee et al. ..... 365/189.09
6,044,000 A * 3/2000 Twardzik ..... 363/90
6,124,743 A * 9/2000 Yang ..... 327/198
6,226,193 B1 * 5/2001 Bayer et al. ..... 363/59
6,366,484 B1 * 4/2002 Jin ..... 363/95
6,462,621 B1 * 10/2002 Charles et al. ..... 330/282

* cited by examiner

*Primary Examiner*—Bao Q. Vu
(74) *Attorney, Agent, or Firm*—Rosenberg, Klein & Lee

(57) ABSTRACT

A programmable voltage supervisory circuit and method with minimum programming pins and low quiescent current is provided to monitor a supply voltage, by which only one programming pin can configure three voltage levels for the threshold voltage to be compared to the supply voltage. The programming pin is connected with a voltage select signal that is defined to be high, low or floating states each determines a setting voltage among three levels corresponding to the three threshold voltages, respectively, by a voltage select circuit. A sample/hold circuit in combination with a switch arrangement is further connected to the voltage select circuit such that the programmable voltage supervisory circuit is only operationable during the duty of a clock and thereby to reduce the power consumption thereof by squeezing the duty.

22 Claims, 5 Drawing Sheets

PROGRAMMABLE VOLTAGE SUPERVISORY CIRCUIT AND METHOD WITH MINIMUM PROGRAMMING PINS AND LOW QUIESCENT CURRENT

FIELD OF THE INVENTION

The present invention relates generally to a circuit and method to monitor a power source, and more particularly to a programmable voltage supervisory circuit and method with minimum programming pins and low quiescent current to monitor a supply voltage.

BACKGROUND OF THE INVENTION

Voltage monitoring circuitry is applied to respond to power source irregularity, such as power crash or power fault, for prevention of a load circuit connected to the power source from malfunctions. For a simple illustration, FIG. 1 shows a power supply 10 providing a voltage VDD to a processor 14. If any fault is occurred in the power supply 10, the voltage on its output 12 may decrease down to smaller than its rating and, as a result, to cause error outputs 16 from the processor 14 or damages to the processor 14. For the sake of prevention, a detector 18 is added to monitor the output 12 of the power supply 10 and sends an alarm signal 20 to the processor 14 if any power drops over its threshold is happened. To generate the alarm signal 20, the detector 18 compares the monitored voltage 12 with a predetermined threshold. However, a constant threshold is not adaptive to various applications, and thus one or more detector chips are needed to replace the original one once the application condition is changed. To meet such requirement, the detector chip manufacturers have to design and manufacture chips for each spec, and the chip agents and system assemblers also have to prepare various chips.

For adaptive detector to monitor the supply voltage, various threshold voltages are provided for the detector 18, as shown in FIG. 2. With this improved circuit, a comparator 22 compares the supply voltage VDD from an input 24 with the other input 26 that receives a varied reference voltage $V_{ref}$ from a threshold generator 28 to generate a monitoring signal 32. To generate a threshold voltage from one of a plurality of predetermined levels, one or more select signals 30 are provided to program the threshold generator 28. Typically, a voltage divider is included in the threshold generator 28 to define the threshold levels. As is well known, a binary signal determines two states for the threshold level. When the level number increases, the pin count of the detector chip 18 becomes more in doubled. For example, three programming pins can determine eight ($=2^3$) levels for the threshold voltages. In addition to the increased cost resulted from the more pins, the resistors of the voltage divider occupies huge chip area and consumes high power when large number of threshold voltages are desired. These resistors further introduce much more noise to the circuit. It is therefore desired a programmable voltage supervisory circuit and method with minimum programming pins and low quiescent current to monitor a power source.

SUMMARY OF THE INVENTION

One object of the present invention is to provide a programmable voltage supervisory circuit and method with reduced programming pins and quiescent current to monitor a supply voltage.

In a programmable voltage supervisory circuit and method to monitor a supply voltage, according to the present invention, only one programming pin configures three voltage levels for the threshold voltage to be compared to the supply voltage and the programming pin is connected with a voltage select signal that is defined among high, low and floating states each determines a setting voltage among three levels corresponding to the three threshold voltages, respectively, by a voltage select circuit. A sample/hold circuit is connected with the setting voltage to generate a threshold voltage among the three threshold voltages in reference to the setting voltage. The generated threshold voltage is then compared to the supply voltage by a comparator to thereby determine a monitoring signal. A switch arrangement is further included in the programmable voltage supervisory circuit such that the voltage select circuit is only operationable during the duty of a clock and, as a result, the power consumption of the programmable voltage supervisory circuit is reduced dramatically by squeezing the duty of the clock.

BRIEF DESCRIPTION OF THE DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

Figure 3:
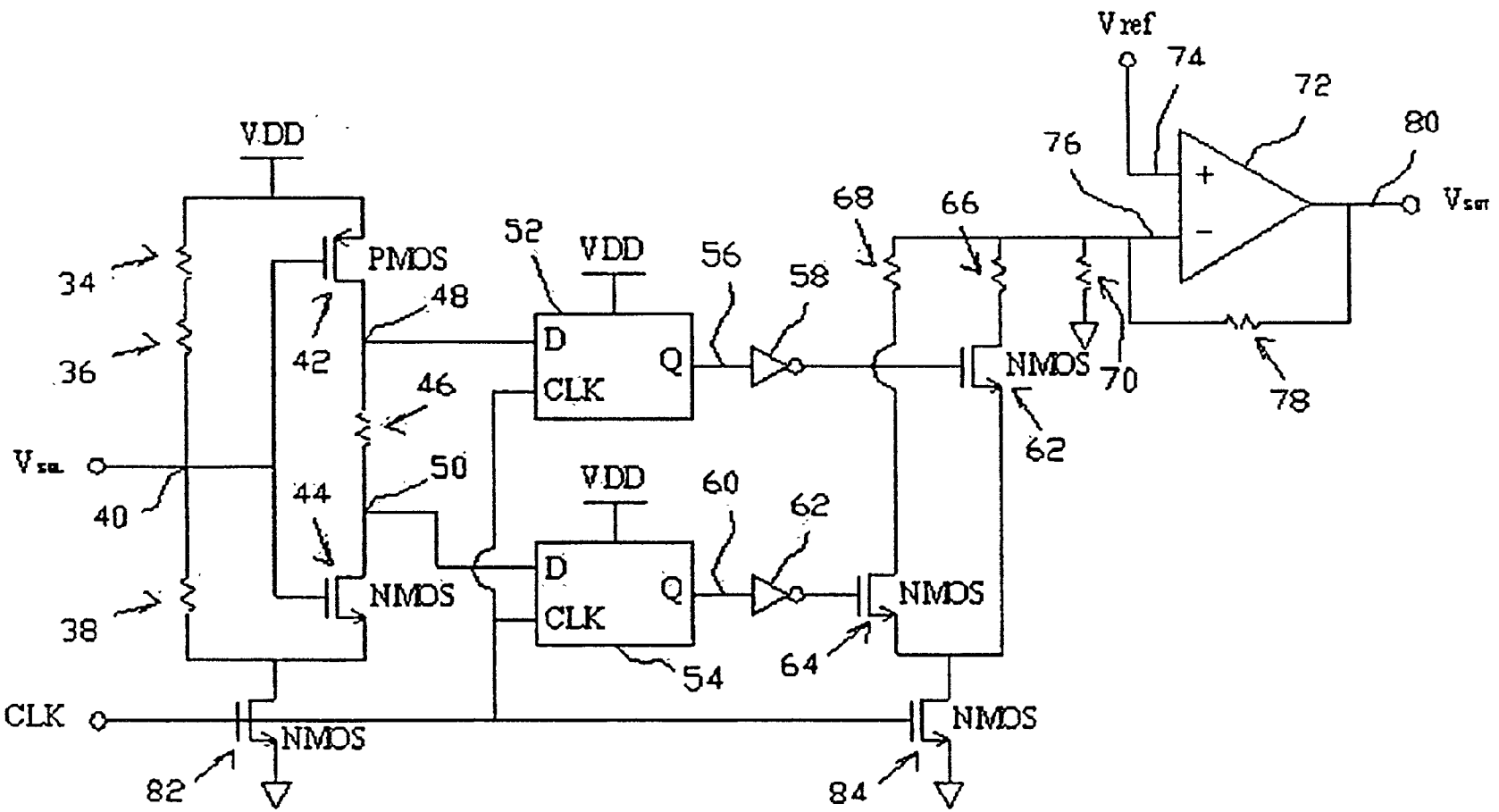
FIG. 3 is an embodiment voltage select circuit according to the present invention.

FIG. 3 shows an embodiment voltage select circuit according to the present invention, whose front-end includes a status determine circuit comprising resistors 34, 36, 38 and 40, PMOS 42 and NMOS 44 connected between the supply voltage VDD and ground. The resistors 34–38 are connected in series to serve as a voltage divider with a taper 46 connected to the gates of the PMOS 42 and NMOS 44, and the resistor 40 is connected between the PMOS 42 and NMOS 44 and is selected to have a resistance high enough to serve as a current limiter and voltage spacer when the PMOS 42 and NMOS 44 both are turned on.

The taper 46 is also connected with a voltage select signal $V_{SEL}$ that is predefined with three states, i.e., high, low and floating to generate a pair of state signals 48 and 50 from the drains of the PMOS 42 and NMOS 44, respectively. In a positive logic scheme, the voltage select signal $V_{SEL}$ will pull high the voltage on the taper 46 when it is a logic "1", and thus the state signals 48 and 50 both are logic "0". If the voltage select signal $V_{SEL}$ is a logic "0", it will pull low the voltage on the taper 46 and, as a result, generate the state signals 48 and 50 both of logic "1". When the voltage select signal $V_{SEL}$ is floating, the voltage divider will determine the voltage on the taper 46 and result in logic "1" and "0" for the state signals 48 and 50, respectively. In this circumstances, the PMOS 42 and NMOS 44 both are turned on, and the resistor 40 will server as a current limiter to limit the current flowing through the PMOS 42 and NMOS 44 and serve as a voltage spacer, due to its high resistance, to keep the state signal 48 at high state and the state signal 50 at low state. For clarification, the state chart is listed in Table 1.

TABLE 1

| Voltage Select Signal $V_{SEL}$ | State Signal 48 | State Signal 50 |
|---|---|---|
| 1 | 0 | 0 |
| 0 | 1 | 1 |
| x | 1 | 0 |

The state signals 48 and 50 are latched by D-latches 52 and 54, respectively. The D-latches 52 and 54 are also connected with a clock CLK for synchronous operations and generate outputs 56 and 58 that are further buffered by inverters 60 and 61 to control NMOSes 62 and 64 for connection and disconnection of resistors 66 and 68 to ground, respectively. Both of the resistors 66 and 68 are connected to resistor 70 in parallel to form a resistor network whose equivalent resistance is determined by the state of the voltage select signal $V_{SEL}$ or, subsequently, the state signals 48 and 50. The resistor network is connected to one input 76 of an operational amplifier 72 whose another input 74 is connected with a reference voltage $V_{ref}$. A reference resistor 78 is connected between the input 76 and output 80 of the operational amplifier 72.

Dependent on the configuration of the NMOSes 62 and 64, the resistor network composed of resistors 66–70 has three equivalent resistances $R_{net}$ corresponding to the three states of the voltage select signal $V_{SEL}$, respectively. Based on circuit theory, the setting voltage $V_{SET}$ on the output 80 of the operational amplifier 72 is determined by $$V_{SET}=V_{ref}\times(R_{ref}+R_{net})/R_{net},$$

where $R_{ref}$ is the resistance of the reference resistor 78. By turning on and off the NMOSes 62 and 64, the setting voltage $V_{SET}$ has three levels whose level spaces are determined by the resistor network configuration and the reference resistance $R_{ref}$.

Apparently, only one programming pin $V_{SEL}$ is capable of programming three setting voltage $V_{SET}$ by the voltage select circuit shown in FIG. 3 for threshold voltage. When more threshold voltages are desired, it can be achieved by more programming pins $V_{SEL}$ each will triple the number of the threshold voltages by $$L_{TH}=3^N,$$

where $L_{TH}$ is the number of the threshold voltages and N is the number of the programming pins. This manner the pin count of the programmable voltage supervisory circuit is dramatically reduced.

Figure 5:
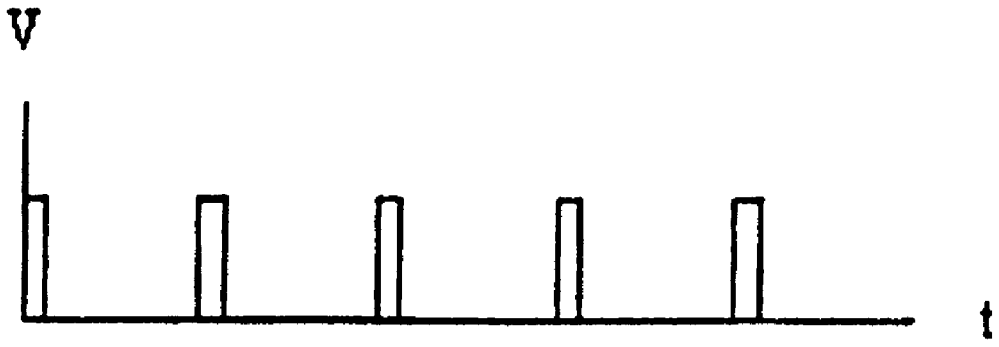
FIG. 5 shows an embodiment clock for the circuit operation according to the present invention.

On the other hand, the operational amplifier 72 is clocked by the clock CLK and NMOSes 82, 83 and 84 common gated with the clock CLK are further included in the voltage select circuit, as shown in FIG. 3, by which the status determine circuit, the resistor network 66–70 in combination with NMOSes 62 and 64, and the operational amplifier circuit are operationable only during the duty of the clock CLK and thus most of time they consume a small or almost no current. Therefore, the power consumption can be dramatically reduced by squeezing the duty of the clock CLK, as shown in FIG. 5.

Figure 4:
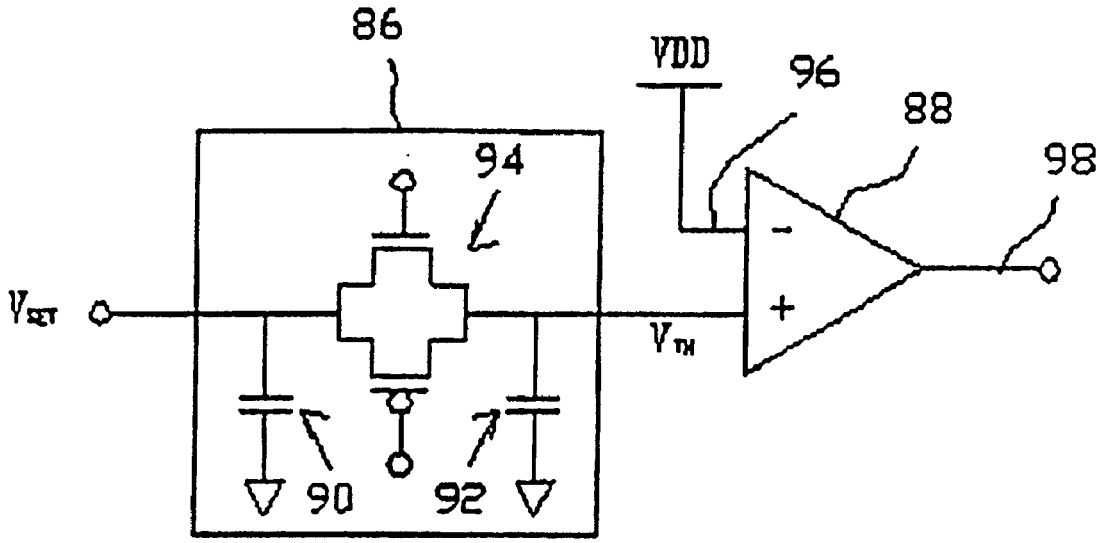
FIG. 4 is an embodiment sample/hold circuit according to the present invention.

The setting voltage $V_{SET}$ generated by the voltage select circuit shown in FIG. 3 is connected to a sample/hold circuit, which is embodied in FIG. 4. The sample/hold circuit 86 includes an input capacitor 90 and an output capacitor 92 with a pass gate 94 connected therebetween. The input capacitor 90 is charged by the setting voltage $V_{SET}$, and the pass gate 94 is periodically turned on, e.g. under the control of the clock shown in FIG. 5, to transfer part of the charges on the input capacitor 90 to the output capacitor 92. The voltage on the output capacitor 92 is then serving as a threshold voltage $V_{TH}$ to be compared with the supply voltage VDD by a real time comparator 88 to generate a monitoring signal 98, for example, at high state if VDD drops to under threshold and at low state under normal operation.

Figure 1:
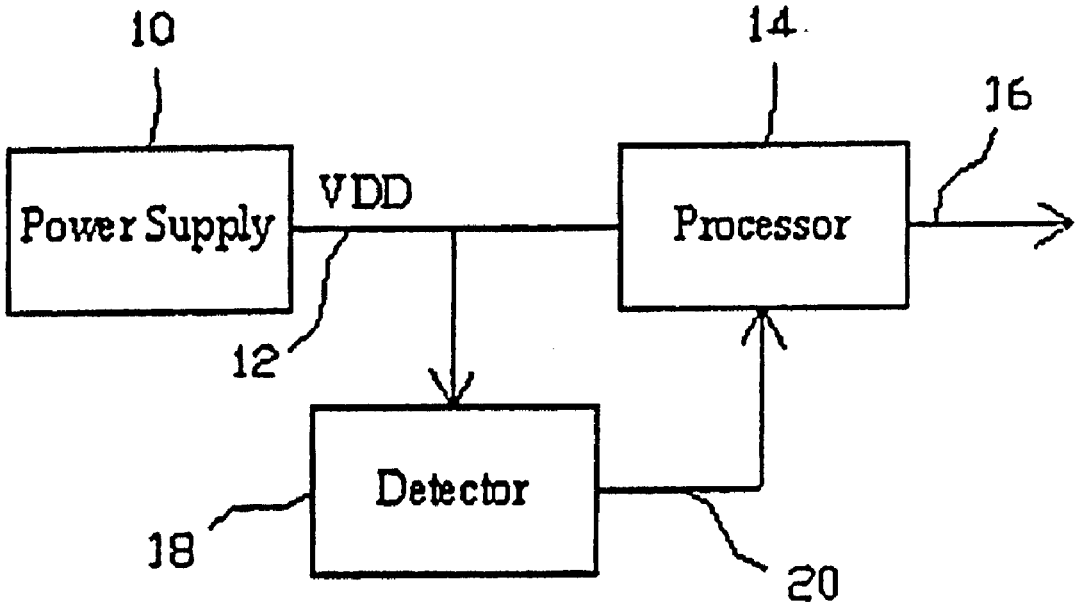
FIG. 1 illustrates a circuit with a detector to monitor the supply voltage.
Figure 2:
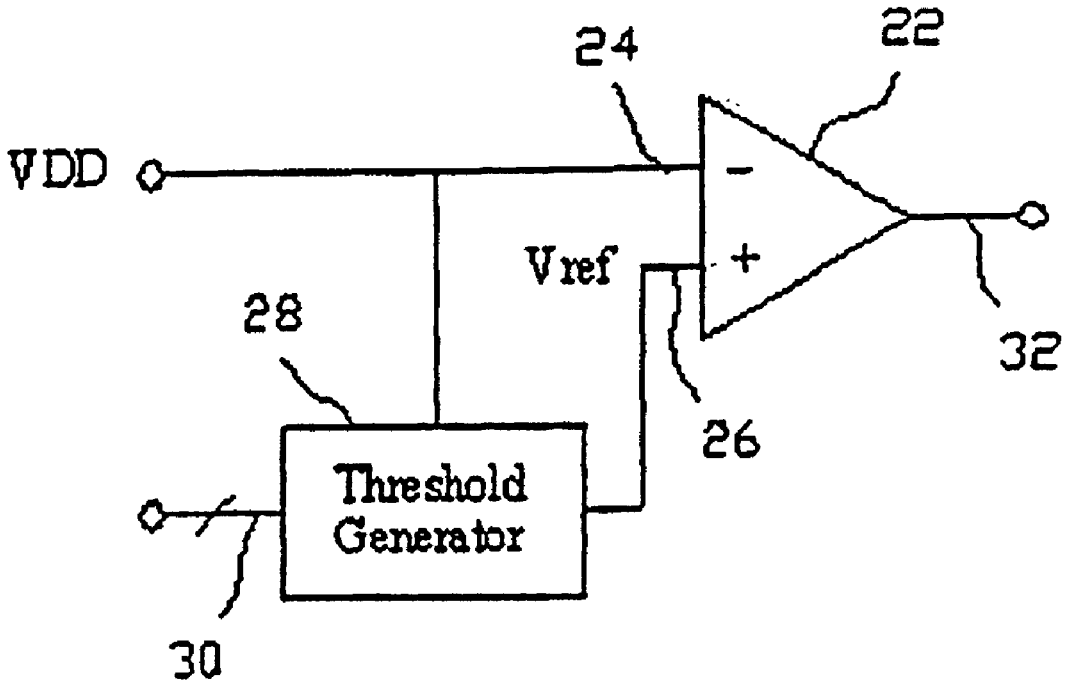
FIG. 2 shows a circuit with various threshold voltages for the detector shown in FIG. 1.

Combination of the circuits shown in FIGS. 3 and 4 now can be applied to the detector 18 shown in FIG. 1 or the detector shown in FIG. 2 with minimum programming pins and low quiescent current.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A programmable voltage supervisory circuit, comprising:

a voltage select circuit connected with a voltage select signal being one of a high, low and floating states for generating a setting voltage being one of a first to third levels in response to said voltage select signal, said voltage select circuit including:

a status determine circuit for generating a pair of state signals representative of said voltage select signal being said high, low or floating states, and a voltage generator for generating said setting voltage in reference to said pair of state signals, said voltage generator including:

a latch for latching said pair of state signals, a buffer for buffering said latched pair of state signals, a resistor network, a switch assembly for configuring said resistor network to thereby determine an equivalent resistance by said buffered pair of state signals, and an operational amplifier circuit for generating said setting voltage by amplifying a reference voltage with a gain being a ratio of a summation of a reference resistance from a reference resistor and said equivalent resistance to said equivalent resistance;

a sample/hold circuit for generating a threshold voltage by sampling and holding said setting voltage; and a real time comparator for generating a monitoring signal by comparing said supply voltage with said threshold voltage.

2. A programmable voltage supervisory circuit according to claim 1, wherein said latch is connected to a switch such that said latch is operationable during a duty of a clock.

3. A programmable voltage supervisory circuit according to claim 1, wherein said latch comprises a pair of D-latches connected to a clock and said pair of state signals for storing said pair of state signals, respectively.

4. A programmable voltage supervisory circuit according to claim 1, wherein said buffer comprises a pair of inverters connected to said pair of state signals, respectively.

5. A programmable voltage supervisory circuit according to claim 1, wherein said resistor network and switch assembly are connected to a switch such that said resistor network and switch assembly are conductive during a duty of a clock.

6. A programmable voltage supervisory circuit according to claim 1, wherein said switch assembly comprises a pair of switches each controlled by one of said pair of state signals to connect and disconnect a respective resistor to said reference resistor.

7. A programmable voltage supervisory circuit according to claim 1, wherein said operational amplifier circuit comprises an operational amplifier having two inputs connected with said reference voltage and resistor network, respectively, and one output with said reference resistor connected between said output and resistor network.

8. A programmable voltage supervisory method, comprising the steps of:

defining a high, low and floating states for a voltage select signal;

generating a setting voltage being one of a first to third levels in response to said voltage select signal, said step of generating a setting voltage comprises the steps of:

generating a pair of state signals representative of said voltage select signal being said high, low or floating states; and generating said setting voltage in reference to said pair of state signals;

sampling and holding said setting voltage for generating a threshold voltage; and comparing said supply voltage with said threshold voltage for generating a monitoring signal.

9. A programmable voltage supervisory method according to claim 8, further comprising the steps of:

latching said pair of state signals;

buffering said latched pair of state signals;

configuring a resistor network for thereby determining an equivalent resistance by said buffered pair of state signals; and amplifying a reference voltage with a gain being a ratio of a summation of a reference resistance from a reference resistor and said equivalent resistance to said equivalent resistance to be said setting voltage.

10. A programmable voltage supervisory method according to claim 9, further comprising clocking said steps of latching said pair of state signals, configuring a resistor network, and amplifying a reference voltage by a clock with a duty smaller than a half of a period of said clock.

11. A voltage generator for producing an output voltage among three levels by an input signal selectively among a high, low and floating states each determining one of said three levels, said voltage generator comprising:

a voltage divider having a taper connected with said input signal;

a pair of PMOS and NMOS connected in series and common gated to said input signal for outputting a pair of state signals derived from a drain of said PMOS and a drain of said NMOS, respectively;

a spacer resistor connected between said drains of said PMOS and NMOS;

a resistor network configured by said pair of state signals for determining an equivalent resistance; and an operational amplifier circuit for generating said output voltage by amplifying a reference voltage with a gain being a ratio of a summation of a reference resistance from a reference resistor and said equivalent resistance to said equivalent resistance.

12. A voltage generator according to claim 11, further comprising a latch for latching said pair of state signals.

13. A voltage generator according to claim 11, further comprising a buffer for buffering said pair of state signals.

14. A voltage generator according to claim 11, further comprising a switch assembly for configuring said resistor network to thereby determine said equivalent resistance by said pair of state signals.

15. A voltage generator according to claim 11, wherein said spacer resistor has a resistance for pushing said state signals away from each other more than a predetermined value when said input signal is at said floating state.

16. A voltage generator according to claim 11, further comprising a switch arrangement configured such that said voltage divider, pair of PMOS and NMOS, spacer resistor, resistor network, and operational amplifier circuit are operationable during a duty of a clock.

17. A method for generating an output voltage among three levels by an input signal selectively among a high, low and floating states each determining one of said three levels, said method comprising the steps of:

connecting a voltage divider between a high and low voltages;

connecting said input signal to a taper of said voltage divider;

connecting a pair of common gated PMOS and NMOS in series between said high and low voltages;

connecting said taper to said gates of said PMOS and NMOS;

inserting a spacer resistor between drains of said PMOS and NMOS;

deriving a pair of state signals from said drains of said PMOS and NMOS in response to said high, low and floating states;

configuring a resistor network by said pair of state signals for determining an equivalent resistance; and amplifying a reference voltage with a gain being a ratio of a summation of a reference resistance from a reference resistor and said equivalent resistance to said equivalent resistance to be said output voltage.

18. A method according to claim 17, further comprising latching said pair of state signals.

19. A method according to claim 17, further comprising buffering said pair of state signals.

20. A method according to claim 17, further comprising switching at least one switch for configuring said resistor network to thereby determine said equivalent resistance by said pair of state signals.

21. A method according to claim 17, further comprising producing a voltage drop across said spacer resistor for pushing said state signals away from each other more than a predetermined value when said input signal is at said floating state.

22. A method according to claim 17, further comprising clocking at least one switch for controlling said voltage divider, pair of PMOS and NMOS, spacer resistor and resistor network being operationable during a duty of a clock.

* * * * *